United States Patent [19]

Zinniger

[11] 4,237,961

[45] Dec. 9, 1980

[54] DIRECT CHILL CASTING METHOD WITH COOLANT REMOVAL

[75] Inventor: Theodore C. Zinniger, Livermore, Calif.

[73] Assignee: Kaiser Aluminum & Chemical Corporation, Oakland, Calif.

[21] Appl. No.: 959,956

[22] Filed: Nov. 13, 1978

[51] Int. Cl.[3] ..... B22D 11/124

[52] U.S. Cl. ..... 164/89; 15/210 R; 118/125; 164/444; 175/84; 427/355; 427/374.5

[58] Field of Search ..... 164/89, 444, 76, 270, 164/417; 427/355, 374 D, 398 B; 118/120, 122, 125, DIG. 11, DIG. 18; 15/210 R; 166/82, 84; 175/84; 251/1 B

[56] References Cited

U.S. PATENT DOCUMENTS

| | | | |
|---|---|---|---|
| 2,648,862 | 8/1953 | Barnes | 15/210 B |
| 2,705,353 | 4/1955 | Zeigler | 164/89 |

*Primary Examiner*—Robert D. Baldwin
*Assistant Examiner*—J. Reed Batten, Jr.
*Attorney, Agent, or Firm*—Paul E. Calrow; Edward J. Lynch

[57] ABSTRACT

The invention relates to a D.C. casting assembly having an inflatable, rubber-like collar near the discharge end of the mold for removing coolant from the surface of the solidified metal. The collar, which surrounds the metal exiting from the mold is initially deflated to allow the large butt of the ingot or billet to pass through without contact and then inflated to effect contact with the ingot or billet and thereby remove coolant.

3 Claims, 5 Drawing Figures

DIRECT CHILL CASTING METHOD WITH COOLANT REMOVAL

BACKGROUND OF THE INVENTION

This invention generally relates to the widely used continuous or semicontinuous D.C. (direct chill) casting of metal products, particularly light metal products such as aluminum. In this casting process, molten metal is introduced into the feed end of an open-ended, tubular mold and, as this metal stream passes through the mold bore, it is cooled and thus solidified at least in part. When the metal emerges from the discharge end of the mold, it is sprayed with coolant to complete metal solidification.

Molten metal introduced into the feed end of the mold rapidly forms a thin layer of solidified metal immediately adjacent the chill surfaces of the mold bore. As the solidification continues, the metal stream contracts and pulls away from the mold wall, and, once contact is lost with the chill surfaces of the mold bore, relatively little heat removal is effected through the mold walls. Thereafter, essentially all solidification is effected by the application of coolant onto the metal as it emerges from the discharge end of the mold.

The solidification of metal in the D.C. casting process usually creates extremely large thermal gradients between the surface and the center of the solidified metal. These large thermal gradients can develop internal stresses which become so large that cracks and splits develop in the solidified metal during or shortly after the casting thereof. The high strength, highly alloyed aluminum alloys, such as the 7XXX (Al-Zn and Al-Zn-Mg) and the 2XXX (Al-Cu) alloys (Aluminum Association alloy designations), are particularly susceptible to such cracking. Cracking severely reduces the metal recovery rates and thus increases costs because the cracked ingots must either be scrapped or severely cropped.

It has long been recognized, for example, by Zeigler in U.S. Pat. Nos. 2,708,297 and 2,705,353 and Elliott et al in U.S. Pat. No. 3,653,425, that cracking of highly alloyed, D.C. cast ingot or billet could be minimized by removing the coolant from the solidified metal surfaces soon after it is applied to the metal emerging from the discharge end of the mold. By quickly removing the coolant, the high temperature metal at the center of the ingot or billet reheats the cooler metal at the surface resulting in stress relief which prevents or minimizes cracking.

Many types of coolant removing devices such as rubber blades, air knives, rotating brushes or rolls, and the like, have either been suggested or actually employed over the years in an attempt to prevent ingot and billet cracking. However, except for the rubber blade, most of these devices have not been used commercially to any significant extent because they were not practical in the industrial environment for which they were designed. Although frequently used, rubber blades would often be torn or eroded by the rough surface of the butt of the ingot or billet which is formed initially during casting and thereby allow coolant to leak onto the wiped metal surfaces and result in ingot or billet cracks. Additionally, rubber blades would not remove coolant from the metal surface in a uniform manner particularly at corners, where coolant leakage usually occurs. The use of rotating devices such as brushes and rollers presented problems similar to the blade wipes and additionally such devices could not be used on metal having a circular cross section. Air knives were effective in removing coolant but they required excessive volumes of air which rendered them impractical.

Over the years the casting art has progressed to the point that by slightly modifying alloy compositions, improving casting procedures and improving casting mold designs, highly alloyed light metals could be cast in a regular manner. However, even with this progress metal recovery was, and still is, frequently quite low. For example, with highly alloyed, high strength, aluminum alloys such as 7050 aluminum alloy, a metal recovery of 50% is sometimes considered successful, and most of such metal losses are due to cracked ingots.

It is against this background that the present invention was developed.

DESCRIPTION OF THE INVENTION

This invention generally relates to the continuous or semicontinuous D.C. casting process, and in particular is directed to an improved wiping device for removing coolant from the surface of the metal discharged from a D.C. casting mold.

The coolant wiping device in accordance with the invention is provided with an inflatable, elastomeric wiping collar which in the inflated condition is in contact with the ingot or billet completely around the surface thereof. At the start of the cast the elastomeric wiping element or collar is in a deflated condition to allow the large butt end of the ingot or billet to pass through the wiping unit without contacting the elastomeric wiping surfaces to any significant extent. Once the large butt of the ingot or billet passes, the elastomeric wiping collar is inflated so that the surfaces thereof are urged up against the surface of the ingot or billet to thereby remove coolant. At the start of the cast the pressure of the elastomeric element against the surface of the ingot or billet should be relatively low because excessive pressure can halt ingot or billet withdrawal from the mold. During the remainder of the cast the pressure is at adequate levels to remove coolant as desired. At the end of the cast, coolant flow from the mold to the surface of the ingot or billet is terminated before the end of the ingot or billet passes the elastomeric collar to insure that no coolant contacts the ingot or billet surface once coolant has been removed from the surface.

The coolant removed by the wipe is directed away from the metal surface by suitable trough or conduit arrangement to prevent the further contact thereof with the ingot or billet surfaces. Under most circumstances the coolant should be removed from the ingot or billet surface at a distance from about 2 to 20 inches (5.1–50.8 cm) from the discharge end of the mold, preferably 4 to 12 inches (10.2–30.5 cm). The particular distance used depends upon the alloy composition, ingot or billet size and casting speed, and can readily be determined empirically.

The elastomeric wiping collar surrounding the ingot or billet is inflated with a fluid such as air or water so as to provide an adequate distribution of pressure completely around the ingot or billet to remove coolant in the desired manner. A liquid such as water is preferred because it can maintain the temperature of the inflatable element of the wipe at a relatively low level to minimize the thermal degradation of the elastomeric material of the wipe. In a preferred embodiment of the invention, water is continuously passed through the inner chamber of the elastomeric collar for improved heat transfer and the pressure within the inner chamber is controlled at the desired level by suitable means such as a valve on the discharge line.

The inflatable collar of the wiping assembly will generally be a singular unit and it will define a single continuous chamber for containment of the inflating fluid in order to apply uniform pressure of the collar on the metal. However, under some circumstances, it may be desirable to segment the inflatable collar into separate inflatable chambers so that different pressure levels can be maintained in the various segments and thereby apply different pressures on various areas of the ingot or billet.

When casting in the vertical direction, it is preferred to suspend or hang the wiper assembly from suitable overhead support such as the casting table so that no significant side thrust is placed on the ingot or billet being cast. Significant side thrusts can detrimentally affect the thin embryo or shell forming within the mold bore resulting in surface defects as well as deformed ingot and billet. Preferred means to support the wiping device are chains or flexible cable which allow the wiping unit to be readily removed when casting alloys which have little or no tendency to crack.

The elastomeric material of the inflatable collar must have sufficient resiliency to expand in the manner desired to contact the metal exiting from the discharge end of the mold, and it must be tough enough to withstand the vigorous environment in which it is employed, particularly the abrasion resulting from wiping the ingot or billet surfaces. Suitable elastomeric materials include natural and synthetic rubbers.

Reference is made to FIGS. 1 through 5 which illustrate various aspects of the invention. In the drawings all corresponding parts are numbered the same.

Figure 1:
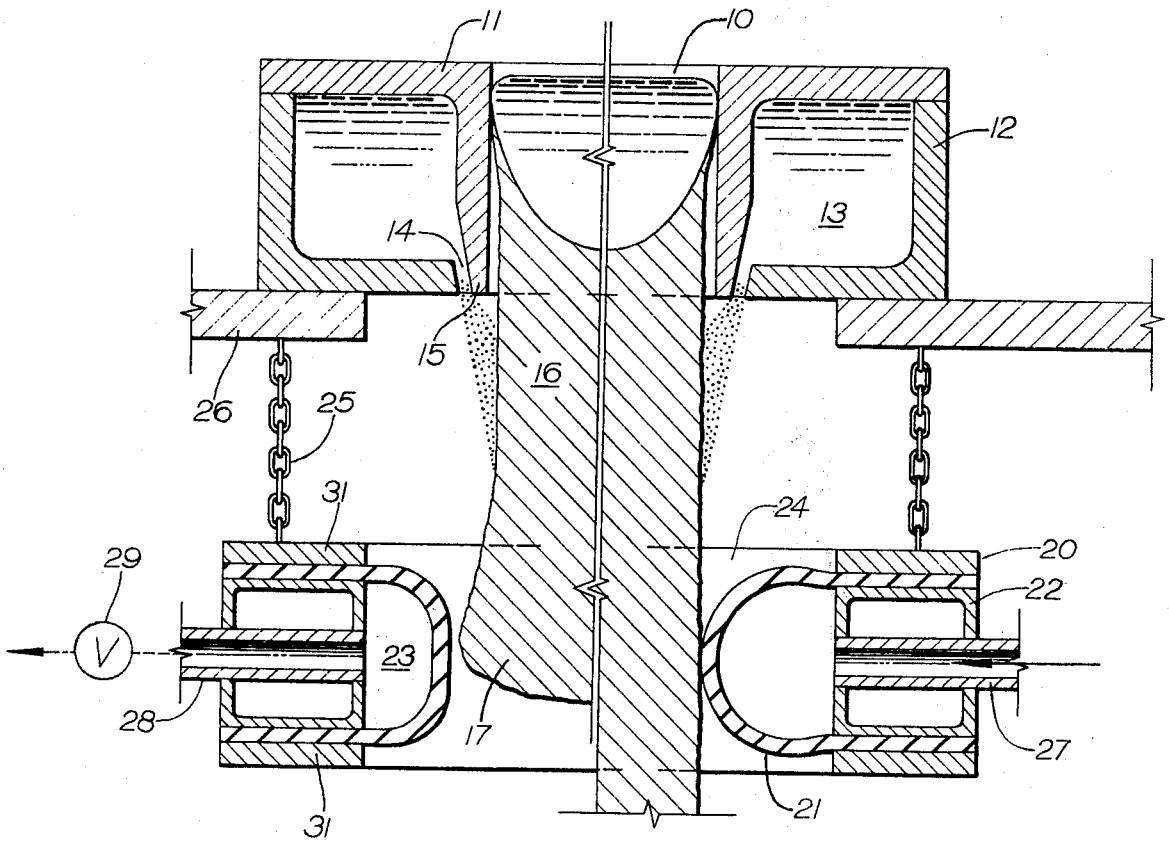
FIG. 1 is a cross sectional view of the assembly of the invention comprising a coolant removal device in conjunction with a DC casting mold.
Figure 3:
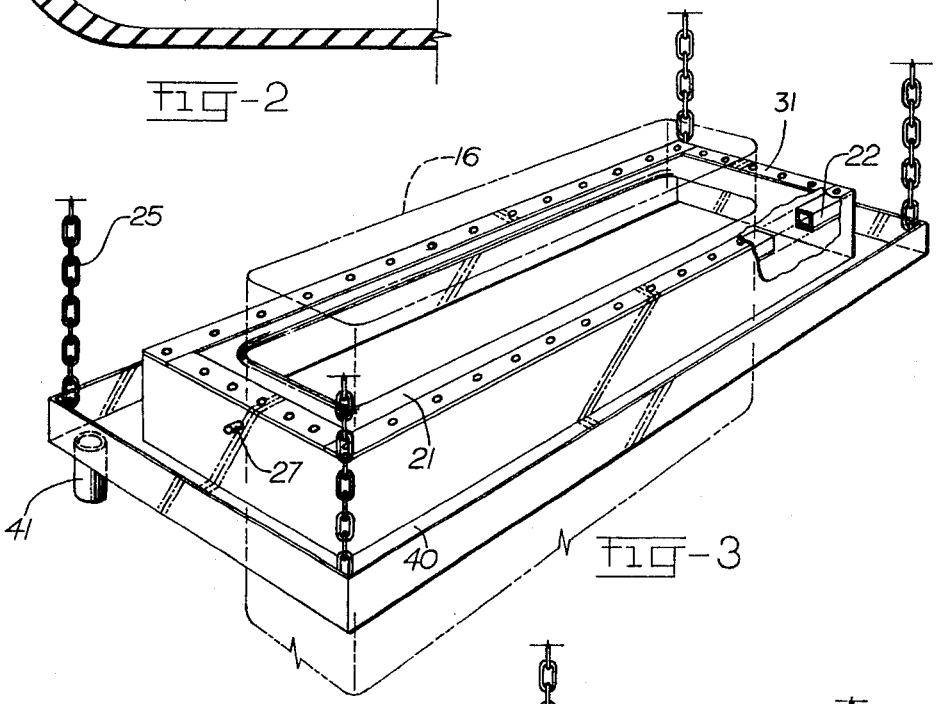
Figure 4:
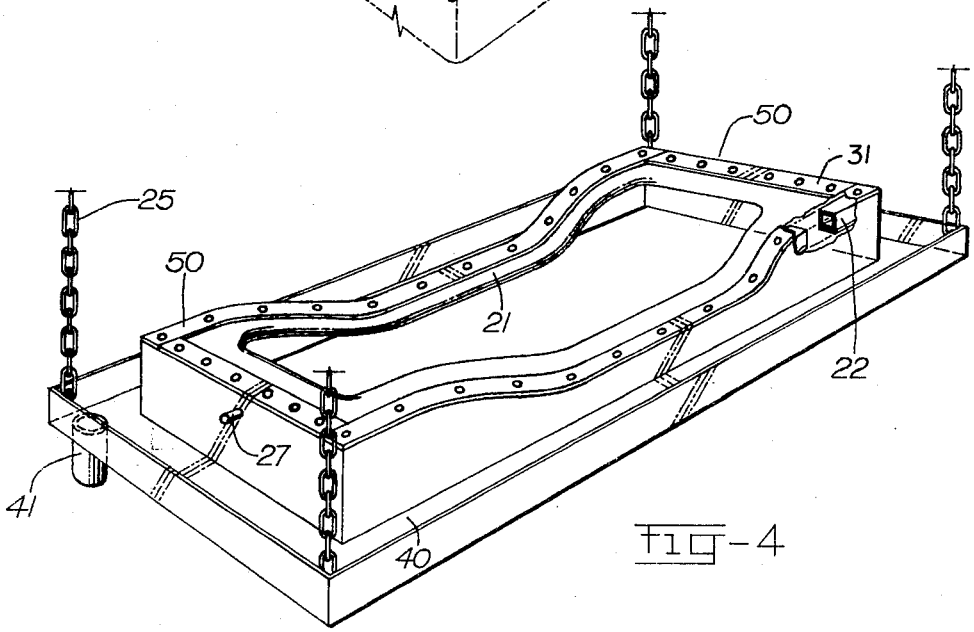
Figure 5:
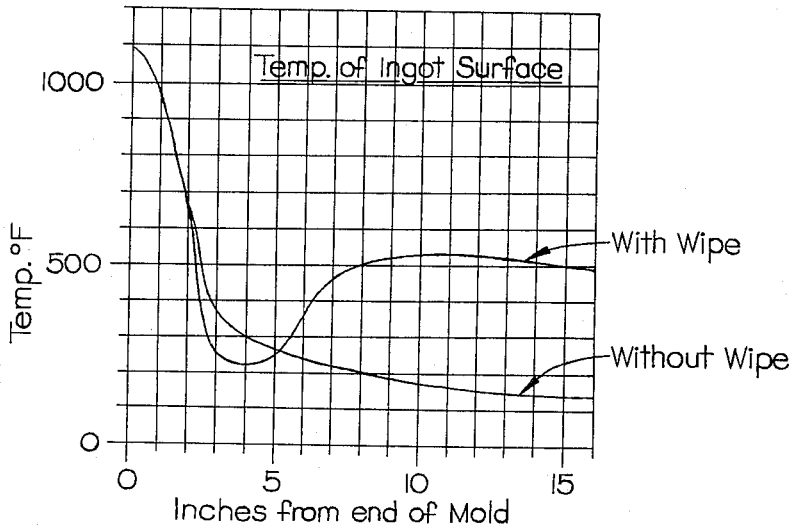

FIGS. 3 and 4 are perspective views of the coolant removal device of the invention shown partially in section FIG. 5 is a graph illustrating the effect of the wiping assembly on reheating of the ingot surface FIG. 1 is a cross-sectional view of a highly simplified D.C. casting assembly illustrating the operation of the wiping system of the invention. Molten metal is introduced into the feed end 10 of the mold body 11 which is surrounded by a water jacket 12. The water jacket 12 and the mold body 11 form a chamber 13 which maintains a body of coolant around the outer periphery of the mold body 11. Coolant from chamber 13 is directed through a suitable slot or openings 14 at the discharge end 15 of the mold onto the solidified or partially solidified ingot 16. In FIG. 1 the drawing is bisected through the mold axis to illustrate on the left the start-up of the casting and on the right the normal operation of the unit after the butt 17 of the ingot or billet has passed through the wiping unit 20. The wiping assembly 20, which is disposed a short distance away from the discharge end 15 of the mold and in axial alignment with the mold bore, comprises an inflatable elastomeric collar 21 and a ring-shaped frame 22 to which the element 21 is attached by means of plates 31. The frame 22 is provided with a passageway 24 through the center thereof which is essentially the same shape as, but larger than, the transverse cross section of the ingot or billet which is to pass through. The inflatable element 21 in conjunction with the frame 22 defines a chamber 23 for containing the inflating fluid. The assembly 20 is supported by chains 25 from the casting table 26 which also supports the mold assembly. A conduit 27 is provided to direct inflating fluid into the inner chamber 23 of wiping element 21, and conduit 28 is provided to discharge the inflating fluid from chamber 23. In a preferred embodiment water is continuously supplied to chamber 23 and the pressure within the chamber is controlled on the discharge line 28, by means of a valve 29.

As shown on the left-hand side of FIG. 1, wiping element 21 is in a deflated condition at the start of the cast to allow the large butt end 17 of the ingot 16 to pass without contacting the elastomeric member 21. Once the fat butt 17 has passed, chamber 23 is then inflated so that the elastomeric member 21 contacts the surface of billet or ingot 16 with sufficient pressure to remove coolant.

Figure 2:
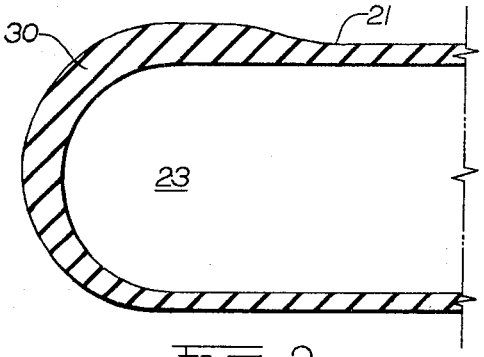
FIG. 2 is a partial cross sectional view illustrating a modified inflatable collar suitable for use in the invention.

FIG. 2 is a cross-sectional view of a modified inflatable elastomeric element 21 wherein the section 30 which is to be in contact with the ingot or billet is thickened to provide improved operational life.

FIG. 3 is a perspective view, partially in section, of a preferred wiper assembly of the invention with the casting mold and casting table removed for purposes of illustration. The inflated wiping surface 21 is shown in contact with the ingot or billet 16 shown in phantom lines to remove coolant from the surface thereof. The coolant removed overflows into trough 40 and is directed into the casting pit away from the ingot or billet through down spout 41 so that no further coolant-metal contact occurs. The wiper assembly 20 is suspended by means of chains 25 to avoid any side thrust on the ingot 16.

FIG. 4 is a perspective view of another embodiment of the invention in which the ends 50 of the wiping assembly project closer to the discharge end of the mold than those sections of wiping collar 21 adjacent to the center of the large surfaces of the ingot in order to remove coolant from the narrow faces and corners of the ingot before coolant is removed from the center sections of the broad faces of the ingot. This embodiment provides a more uniform surface temperature across the ingot in a plane perpendicular to the ingot axis, which may be desirable when the ingot to be cast has a large aspect ratio (ratio of large dimension to small dimension of cross section), i.e. greater than 2.

FIG. 5 is a graph comparing the temperature of the ingot surface at various distances from the discharge end of the mold with and without the wiping assembly of the invention in operation. As is evident from the graph, a substantial reheating of the ingot surface occurs with the wiping assembly in operation, whereas essentially no reheating occurs without the wipe.

The following example is provided to further illustrate a preferred embodiment of the invention.

EXAMPLE

To determine the effectiveness of the wiping system of the invention, eight 16×54 inch (40.6×137.2 cm) rectangular ingots were D.C. cast from a melt of 7050 aluminum alloy. During the casting the wiping device of the invention was utilized to remove coolant from the surface of four of the ingots, whereas conventional rubber blade wipes were used to remove coolant from the surface of the other four ingots. The molten metal composition and temperature and the casting procedures were essentially the same in all instances. Coolant was removed from the ingot surfaces at a distance of 10 inches (25.4 cm) from the bottom of the mold. All four ingots which were cast employing the wiping device of the invention exhibited no cracks. Out of the four ingots which were cast using the conventional rubber blades, two cracked in areas where coolant leaks occurred.

All references herein to numbered aluminum alloys refer to the Aluminum Association alloy designations.

It is obvious that various modifications can be made to the invention without departing from the spirit thereof and the scope of the appended claims. For example, the description of the invention has been directed primarily to casting in the vertical direction, whereas, the invention can be employed when casting in the horizontal direction.

I claim:

1. In the method of D.C. casting ingot or billet wherein coolant is applied to the ingot or billet and wherein coolant is subsequently removed from the ingot or billet, the improvement comprising:

A. passing the ingot or billet through an inflatable elastomeric collar;

B. maintaining the collar in a deflated condition at the start-up of casting to allow the large butt of the ingot or billet formed during start-up to pass through the collar with essentially no contact therewith, and C. inflating the collar after the passage of the large butt of the ingot or billet through the collar to urge the collar into substantial contact with periphery of the ingot or billet to thereby remove coolant from the surfaces thereof.

2. The method of claim 1 wherein the inflatable collar is inflated with water.

3. The method of claim 2 wherein water is continuously passed through the inflated collar to maintain the temperature of the elastomeric material of the collar at a desired level.

* * * * *